US006845926B2

(12) United States Patent
Lei

(10) Patent No.: US 6,845,926 B2
(45) Date of Patent: Jan. 25, 2005

(54) FUEL INJECTOR WITH DUAL CONTROL VALVE

(75) Inventor: Ning Lei, Oak Brook, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 233 days.

(21) Appl. No.: 10/072,490

(22) Filed: Feb. 5, 2002

(65) Prior Publication Data

US 2003/0155437 A1 Aug. 21, 2003

(51) Int. Cl.[7] ..... F02M 59/00; F02M 39/00; B05B 1/30

(52) U.S. Cl. ..... 239/533.2; 239/533.3; 239/585.1; 239/585.5; 239/88

(58) Field of Search ..... 239/533.2, 533.3, 239/533.8, 533.9, 585.1, 585.2, 585.4, 585.5, 5, 88–92, 96, 124, 127; 251/129.15, 129.21, 127

(56) References Cited

U.S. PATENT DOCUMENTS

| | | | |
|---|---|---|---|
| 4,440,132 | A | 4/1984 | Terada et al. |
| 5,181,494 | A | 1/1993 | Ausman et al. |
| 5,460,329 | A | 10/1995 | Sturman |
| 5,463,996 | A | 11/1995 | Maley et al. |
| 5,535,723 | A | 7/1996 | Gibson et al. |
| 5,551,398 | A | 9/1996 | Gibson et al. |
| 5,622,152 | A | 4/1997 | Ishida |
| 5,628,293 | A | 5/1997 | Gibson et al. |
| 5,640,329 | A | 6/1997 | Matsunaga et al. |
| 5,651,345 | A | 7/1997 | Miller et al. |
| 5,669,355 | A | 9/1997 | Gibson et al. |
| 5,673,669 | A | 10/1997 | Maley et al. |
| 5,682,858 | A | 11/1997 | Chen et al. |

(List continued on next page.)

OTHER PUBLICATIONS

"The Sturman Injector," 1 page illustration of an injector allegedly invented by Oded Sturman as early as May, 1993, according to publicly available documents in Cause No. 99–CV–1201 pending in the Federal District Court for the Central District of Illinois.

S.F. Glassey, A.R. Stockner, M.A. Flinn, Caterpillar, Inc., "HEUI–A New Direction For Diesel Engine Fuel Systems," 93270, , pp. 1–11.

(List continued on next page.)

*Primary Examiner*—Davis Hwu
(74) *Attorney, Agent, or Firm*—Dennis Kelly Sullivan; Susan L. Lukasik; Jeffrey P. Calfa

(57) ABSTRACT

A hydraulically actuated, intensified fuel injector includes a controller achieving a desired injection control strategy by selectively independently porting actuating fluid to and venting actuating fluid from an intensifier piston to control the compressive stroke of the intensifier piston and selectively independently porting actuating fluid to and venting actuating fluid from a needle valve to control the opening and closing of the needle valve during the injection event. A method of control is further included.

53 Claims, 3 Drawing Sheets

U.S. PATENT DOCUMENTS 5,685,490 A 11/1997 Ausman et al.
5,697,342 A 12/1997 Anderson et al.
5,709,341 A 1/1998 Graves
5,738,075 A 4/1998 Chen et al.
5,752,659 A 5/1998 Moncelle
5,862,792 A 1/1999 Paul et al.
5,878,720 A 3/1999 Anderson et al.
5,893,350 A 4/1999 Timms
5,893,516 A 4/1999 Harcombe et al.
5,901,685 A 5/1999 Noyce et al.
5,913,300 A 6/1999 Drummond
5,931,139 A 8/1999 Mack
5,954,030 A 9/1999 Sturman et al.
5,975,792 A 11/1999 Goeken et al.
5,979,415 A 11/1999 Sparks et al.
5,986,871 A 11/1999 Forck et al.
6,024,296 A 2/2000 Wear et al.
6,073,862 A * 6/2000 Touchette et al. ..... 239/408
6,161,770 A 12/2000 Sturman

OTHER PUBLICATIONS

W. Boehner, K. Hummel, "Common Rail Injection Systems For Commercial Diesel Vehicles," 970345, pp. 133–141.

N. Guerrassi, P. Dupraz, "A Common Rail Injection System For High Speed Direct Injection Diesel Engines," 980803, pp. 13–20.

M. Osenga, "CAT Gears Up Next Generation Fuel Systems," North American Edition, Diesel Progress, Aug., 1998, pp. 82–90.

C. Cole, O.E. Sturman, D. Giordano, Sturman Industries, Inc., "Application Of Digital Valve Technology To Diesel Fuel Injection," 1999–01–0196, pp. 1–7.

* cited by examiner

FIG. 2
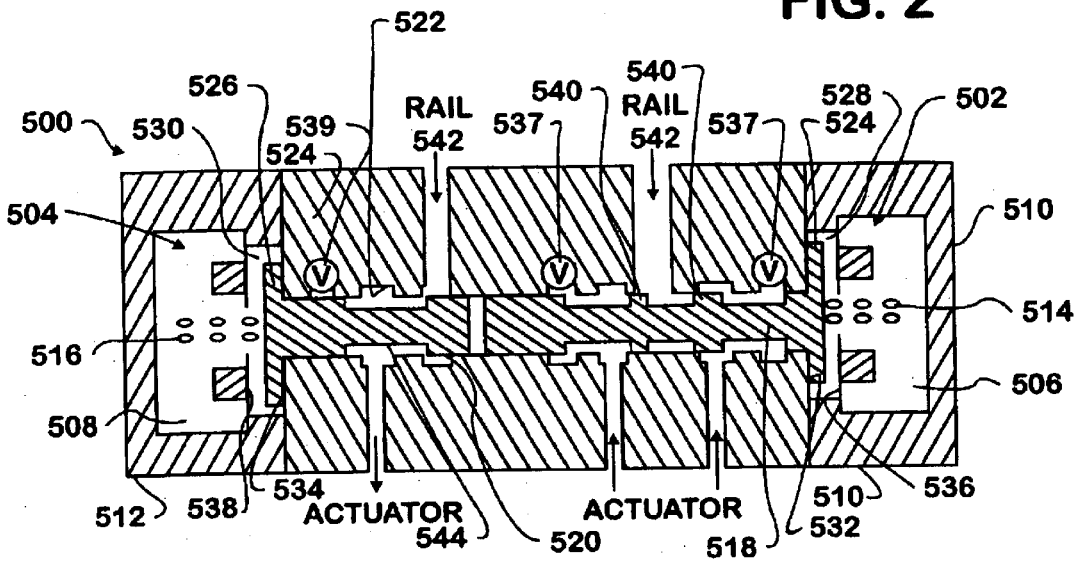
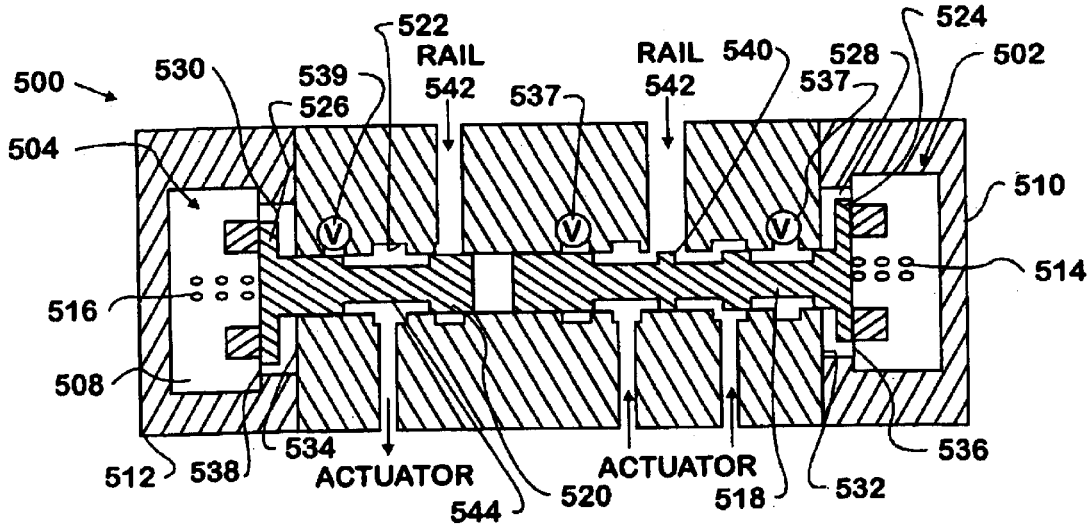
FIG. 3

FUEL INJECTOR WITH DUAL CONTROL VALVE

TECHNICAL FIELD

The present application relates to internal combustion engine valve control. More particularly, the present application relates to independent needle valve control in a hydraulically actuated, intensified fuel injector.

BACKGROUND AND PRIOR ART

Referring to the prior art drawings, FIG. 1 shows a prior art fuel injector 50. The prior art injector 50 is substantially as described in U.S. Pat. No. 5,460,329 to Sturman. A fuel injector having certain similar features may be found in U.S. Pat. No. 5,682,858 to Chen et al. The fuel injector 50 is typically mounted to an engine block and injects a controlled pressurized volume of fuel into a combustion chamber (not shown). The injector 50 is typically used to inject diesel fuel into a compression ignition engine, although it is to be understood that the injector could also be used in a spark ignition engine or any other system that requires the injection of a fluid.

The fuel injector 50 has an injector housing 52 that is typically constructed from a plurality of individual parts. The housing 52 includes an outer casing 54 that contains block members 56, 58, and 60. The outer casing 54 has a fuel port 64 that is coupled to a fuel pressure chamber 66 by a fuel passage 68. A first check valve 70 is located within fuel passage 68 to prevent a reverse flow of fuel from the pressure chamber 66 to the fuel port 64. The pressure chamber 66 is coupled to a nozzle chamber 304 and to a nozzle 72 by means of fuel passage 74. A second check valve 76 is located within the fuel passage 74 to prevent a reverse flow of fuel from the nozzle 72 and the nozzle chamber 304 to the pressure chamber 66.

The flow of fuel through the nozzle 72 is controlled by a needle valve 78 that is biased into a closed position by spring 80 located within a spring chamber 81. The needle valve 78 has a shoulder 82 in the nozzle chamber 304 above the location where the passage 74 enters the nozzle 78. When fuel flows in the passage 74, the pressure of the fuel applies a force on the shoulder 82 in the nozzle chamber 304. The shoulder force acts to overcome the bias of spring 80 and lifts the needle valve 78 away from the nozzle 72, allowing fuel to be discharged from the injector 50.

A passage 83 may be provided between the spring chamber 81 and the fuel passage 68 to drain any fuel that leaks into the chamber 81. The drain passage 83 prevents the build up of a hydrostatic pressure within the chamber 81 which could create a counteractive force on the needle valve 78 and degrade the performance of the injector 50.

The volume of the pressure chamber 66 is defined in part by an intensifier piston 84. The intensifier piston 84 extends through a bore 86 of block 60 and into a first intensifier chamber 88 located within an upper valve block 90. The piston 84 includes a shaft member 92 which has a shoulder 94 that is attached to a head member 96. The shoulder 94 is retained in position by clamp 98 that fits within a corresponding groove 100 in the head member 96. The head member 96 has a cavity which defines a second intensifier chamber 102.

The first intensifier chamber 88 is in fluid communication with a first intensifier passage 104 that extends through block 90. Likewise, the second intensifier chamber 102 is in fluid communication with a second intensifier passage 106.

The block 90 also has a supply working passage 108 that is in fluid communication with a supply working port 110. The supply working port 110 is typically coupled to a system that supplies a working fluid which is used to control the movement of the intensifier piston 84. The working fluid is typically a hydraulic fluid, preferably engine lubricating oil, that circulates in a closed system separate from fuel. Alternatively the fuel could also be used as the working fluid. Both the outer body 54 and block 90 have a number of outer grooves 112 which typically retain O-rings (not shown) that seal the injector 10 against the engine block. Additionally, block 62 and outer shelf 54 may be sealed to block 90 by O-ring 114.

Block 60 has a passage 116 that is in fluid communication with the fuel port 64. The passage 116 allows any fuel that leaks from the pressure chamber 66 between the block 62 and piston 84 to be drained back into the fuel port 64. The passage 116 prevents fuel from leaking into the first intensifier chamber 88.

The flow of working fluid (preferably engine lubricating oil) into the intensifier chambers 88 and 102 can be controlled by a four-way solenoid control valve 118. The control valve 118 has a spool 120 that moves within a valve housing 122. The valve housing 122 has openings connected to the passages 104, 106 and 108 and a drain port 124. The spool 120 has an inner chamber 126 and a pair of spool ports that can be coupled to the drain ports 124. The spool 120 also has an outer groove 132. The ends of the spool 120 have openings 134 which provide fluid communication between the inner chamber 126 and the valve chamber 134 of the housing 122. The openings 134 maintain the hydrostatic balance of the spool 120.

The valve spool 120 is moved between the first position shown in prior art FIG. 1 and a second opposed position, by a first solenoid 138 and a second solenoid 140. The solenoids 138 and 140 are typically coupled to an external controller (not shown) which controls the operation of the injector. When the first solenoid 138 is energized, the spool 120 is pulled to the first position, wherein the first groove 132 allows the working fluid to flow from the supply working passage 108 into the first intensifier chamber 88, and the fluid flows from the second intensifier chamber 102 into the inner chamber 126 and out the drain port 124. When the second solenoid 140 is energized the spool 120 is pulled to the second position, wherein the first groove 132 provides fluid communication between the supply working passage 108 and the second intensifier chamber 102, and between the first intensifier chamber 88 and the drain part 124.

The groove 132 and passages 128 are preferably constructed so that the initial port is closed before the final port is opened. For example, when the spool 120 moves from the first position to the second position, the portion of the spool adjacent to the groove 132 initially blocks the first passage 104 before the passage 128 provides fluid communication between the first passage 104 and the drain port 124. Delaying the exposure of the ports reduces the pressure surges in the system and provides an injector which has predictable firing points on the fuel injection curve.

The spool 120 typically engages a pair of bearing surfaces 142 in the valve housing 122. Both the spool 120 and the housing 122 are preferably constructed from a magnetic material such as a hardened 52100 or **440*c* steel, so that the hysteresis of the material will maintain the spool 120 in either the first or second position. The hysteresis allows the solenoids 138, 140 to be de-energized after the spool 120 is pulled into position. In this respect the control valve 118** operates in a digital manner, wherein the spool 120 is moved by a defined power pulse that is provided to the appropriate solenoid 138,140. Operating the valve 118 in a digital manner reduces the heat generated by the coils and increases the reliability and life of the injector 50.

In operation, the first solenoid 138 is energized and pulls the spool 120 to the first position, so that the working fluid flows from the supply port 110 into the first intensifier chamber 88 and from the second intensifier chamber 102 into the drain port 124. The flow of working fluid into the intensifier chamber 88 moves the piston 84 and increases the volume of chamber 66. The increase in the chamber 66 volume decreases the chamber pressure and draws fuel into the chamber 66 from the fuel port 64. Power to the first solenoid 138 is terminated when the spool 120 reaches the first position.

When the chamber 66 is filled with fuel, the second solenoid 140 is energized to pull the spool 120 into the second position. Power to the second solenoid 140 is terminated when the spool 120 reaches the second position. The movement of the spool 120 allows working fluid to flow into the second intensifier chamber 102 from the supply port 110 and from the first intensifier chamber 88 into the drain port 124.

The head 96 of the intensifier piston 96 has an area much larger than the end of the piston 84, so that the pressure of the working fluid generates a force that pushes the intensifier piston 84 and reduces the volume of the pressure chamber 66. The stroking cycle of the intensifier piston 84 increases the pressure of the fuel within the pressure chamber 66 and, by means of passage 74, in the nozzle chamber 304. The pressurized fuel acts on shoulder 82 in the nozzle chamber 304 to open the needle valve 78 and fuel is then discharged from the injector 50 through the nozzle 72. The fuel is typically introduced to the injector at a pressure between 1000–2000 psi. In the preferred embodiment, the piston has a head to end ratio of approximately 10:1, wherein the pressure of the fuel discharged by the injector is between 10,000–20,000 psi.

The HEUI injector 50 described above is commonly referred to as the G2 injector. The G2 injector 50 uses a fast digital spool valve 120 to control multiple injection events. During its operation, every component inside of the injector 50 (spool valve 120, intensifier piston 84, and needle valve 78) has to open/close multiple times to either trigger the injection or stop the injection during the injection event. The digital spool valve 120 has to handle large flow capacity to supply actuation liquid to the intensifier piston 78. The spool valve 120 size is relatively big and the response of a large spool valve 120 is therefore limited.

The intensifier 84 is also relatively large in mass. Therefore reversing the motion of the intensifier 84 to achieve pilot injection operation is inefficient. Once committed to compression of fuel for injection, it is much more efficient to maintain the intensifier 84 motion in the compressing stroke throughout the duration of the injection event.

Reversing of the motion of the spool valve 120 and the intensifier piston 84 results in the injection event no longer being a single shot injection, but effectively multiple short independent injection events during the injection event. Both the motion of the spool valve 120 and the intensifier piston 84 must be reversed in the duration between the pre-injection and the actual injection and reversed again to effect the "actual" injection. With such relatively massive devices as the spool valve 120 and the intensifier piston 84, this is highly inefficient.

It is believed that pilot or split injection should be injection interruptions effected during a single shot injection, e.g., with no motion reversal of either the spool valve 120 or the intensifier piston 84, but with control of the needle valve 78 opening and closing motions. As indicated above, the intensifier piston 84 has relatively large mass hence it is difficult or slow to reverse its motion.

A responsive injection system should avoid reverse motion of the intensifier 84 and, preferably, of the spool valve 120. Therefore, there is a need in the industry to utilize a mechanism to efficiently control the needle valve 78 independent of intensifier piston 84 and its controller.

SUMMARY OF THE INVENTION

The present invention substantially meets the needs of the industry. Control of the needle valve multiple times during an injection event is achieved by a device that permits the spool valve to cycle only a single time, open at the initiation of the injection event and close after the termination of the injection event, and the intensifier piston to maintain a continuous compressing stroke during the injection event.

The present invention is a hydraulically actuated, intensified fuel injector includes a controller achieving a desired injection control strategy by selectively independently porting actuating fluid to and venting actuating fluid from an intensifier piston to control the compressive stroke of the intensifier piston and selectively independently porting actuating fluid to and venting actuating fluid from a needle valve to control the opening and closing of the needle valve during the injection event. The present invention is further a method of control.

BRIEF DESCRIPTION OF THE DRAWINGS

FIG. 2 is a sectional view of the dual control valve of the present invention with both valves on the off position;

FIG. 3 is a sectional view of the dual control valve of the present invention with both valves on the on position.

DETAILED DESCRIPTION OF THE PREFERRED EMBODIMENT

Figure 4:
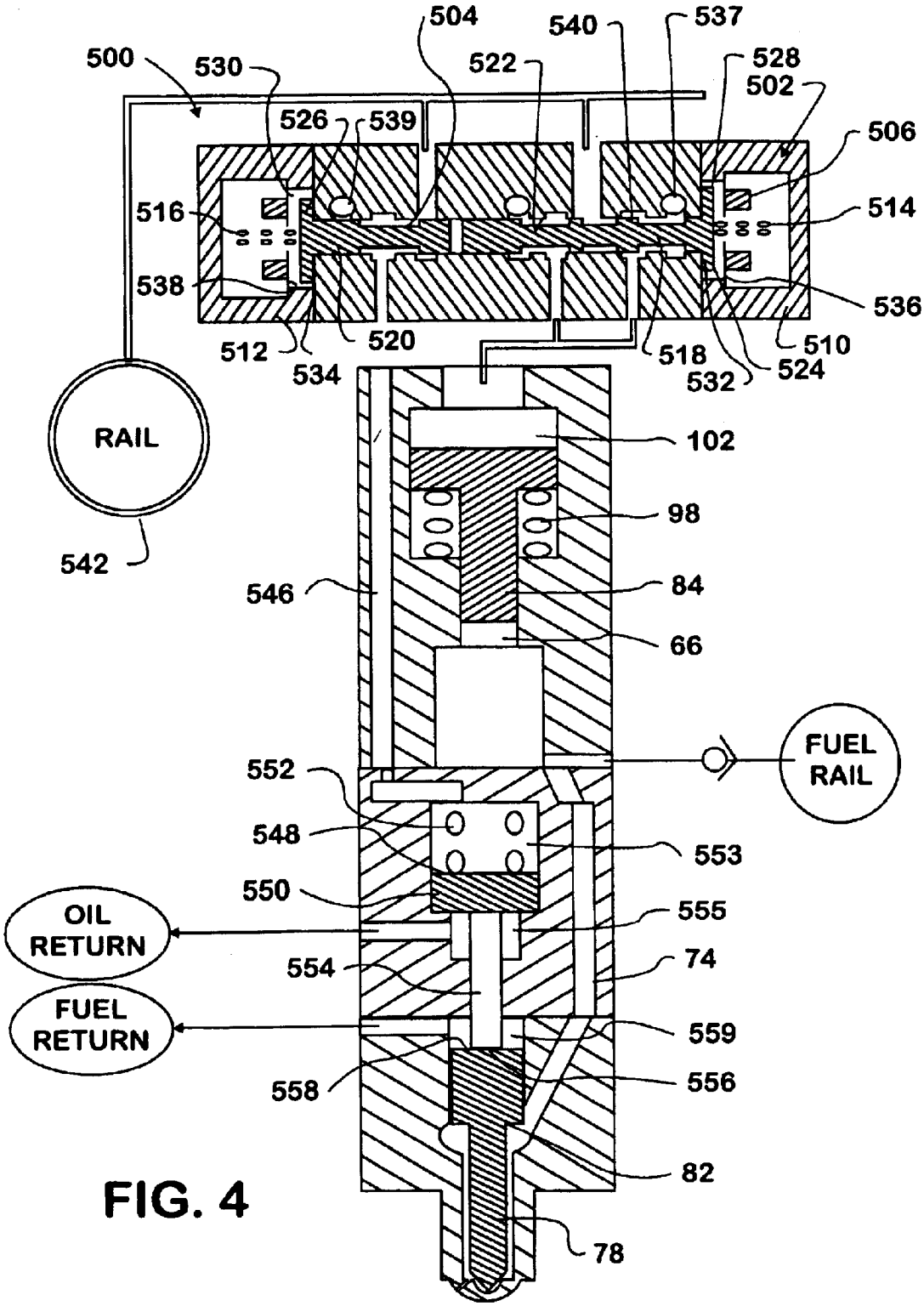
FIG. 4 is a sectional view of a fuel injector incorporating the dual control valve of the present invention.

The present invention is related to the dual control valve, shown generally at 500 in the FIGS. 2 and 3, and the application of the dual control valve 500 to a fuel injection system in FIG. 4.

Referring to FIGS. 2 and 3, the dual control valve 500 has two major components, pressure control valve 502 and timing control valve 504. The pressure control valve 502 and timing control valve 504 of the control valve 500 each include a dedicated respective control coil 506, 508 and cap assemblies 510, 512, respective return springs 514, 516. The pressure control valve 502 includes a single balanced spool valve 518. The timing control valve 504 is comprised of a half spool valve 520 (The timing control valve 504 may also be a poppet valve). Both valves 502, 504 are depicted being on the same longitudinal axis and in this configuration may be installed from both ends in a bore 522 defined in a common housing 524. It should be noted that the valves 502, 504 need not be in the depicted coaxial disposition.

Both valves 502,504 are never in contact with each other and accordingly the valves 502, 504 can be operated independently without interference. Both valves 502, 504 are electronically energized to the on position of FIG. 3 and returned by the respective return spring 514, 516 to the off position of FIG. 2. Both spool valves 502, 504 have a respective large disk plate 524, 526 at one end (air gap side 528, 530) to provide a large magnetic force to provide for actuation of the respective spool valves 502, 504. The disk plates 524, 526 also provide a stop function to the respective spool valves 502, 504 when the respective disk plate 524, 526 has reached (is seated on) either the respective valve housing stop 532, 534 or the respective end cap stop 536, 538. Actuating fluid forms from the high pressure rail 542 as controlled by the valves 502, 504. Actuating fluid is vented via vents 537, 539 as controlled by the valves 502, 504.

The large balanced spool valve 518 is functionally similar to the prior art control valve 120, described above. Spool valve 518 is a flow symmetric valve. Actuating fluid flow therefore goes into both the left and right sides of the lands 540 (flows fully around the lands 540, thereby equalizing the forces generated on both sides of the lands 540) when the spool valve 518 is in the open and flow is from rail 542 (see FIG. 3) or closed position and flow is vented through vents 537 (see FIG. 2). The symmetric flow pattern around the lands 540 allows the spool valve 518 to move with very little or negligible flow force, hence the spool valve 518 provides for more efficient use of magnetic force and has a faster valve response. Symmetric flow around the lands 540 provides for a relatively greater flow area and therefore has the advantage of a smaller valve stroke necessary to achieve the required porting of fluid.

The timing control valve 504 can either be a part of the balanced spool valve, say a half spool valve 520 or a small poppet valve (not shown). The design objective of the timing control valve 504 is to make valve 504 as small as possible in order that the valve 504 have fastest possible response time. A half spool valve 504 has less flow capability than a balanced spool valve, such as spool valve 518, but has faster response time since it has substantially less mass.

It should be noted that in the off position, the pressure control valve 502 is venting actuating fluid to the vents 537 while the timing control valve 504 is porting actuating fluid in from rail 542. Conversely, in the on position the pressure control valve 502 is porting actuating fluid in and timing control valve 504 is venting.

Actuation fluid from the rail 542 is directed to and vented from a different part of the hydraulic system independently both in timing and in duration through the coordination of the independent operation both control valves 502, 504. Following are examples of how the dual control valve 500 is employed to enhance the injection performance.

Figure 1:
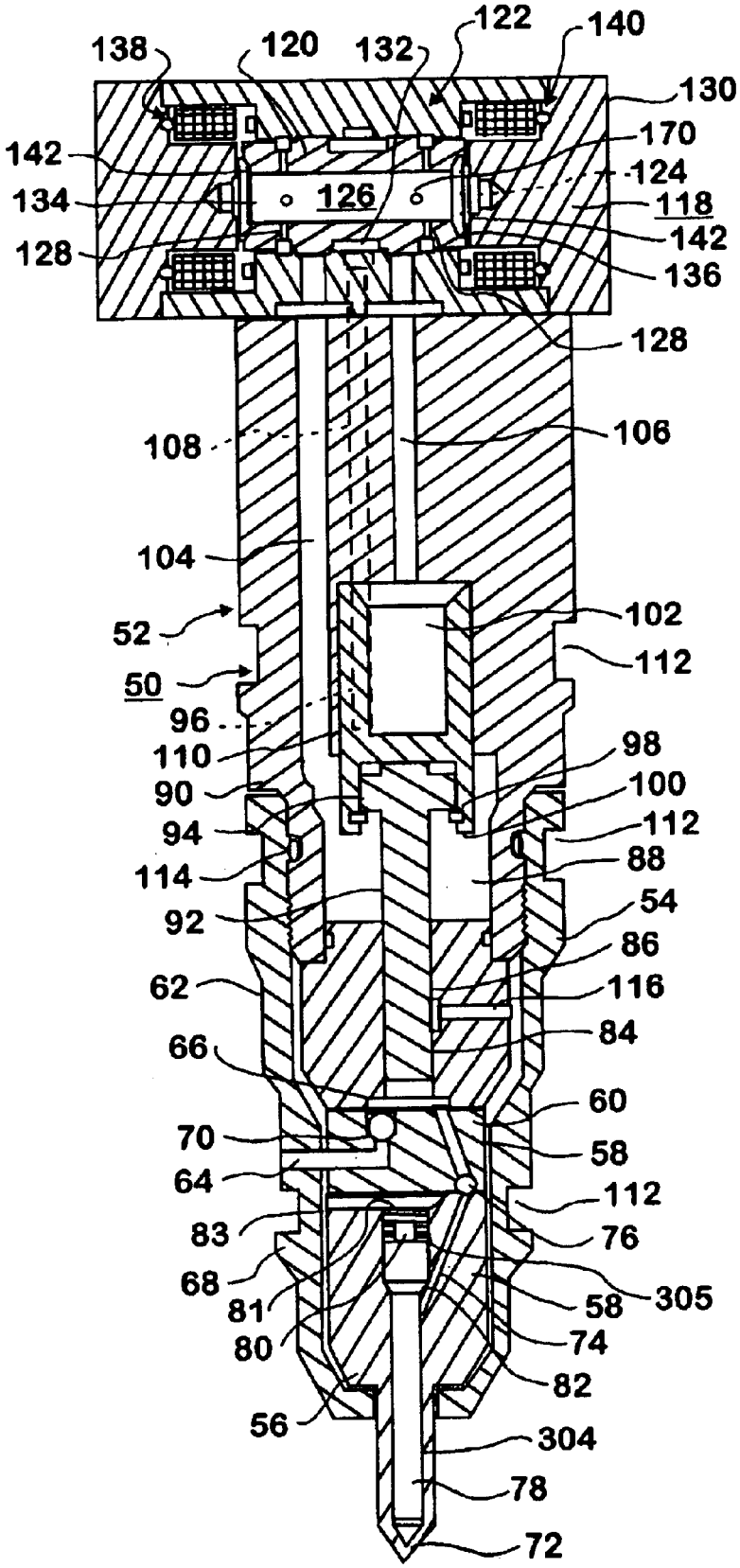
FIG. 1 PRIOR ART
FIG. 1 is a sectional view of a prior art fuel injector.

Fuel Injector Application:

FIG. 4 shows the application of the present invention to a fuel injection system. The prior art injector of FIG. 1 has a single two-position 3-way control valve 120. This single control valve is replaced in the present invention by the two-position 3-way valves 502, 504 of the dual control valve 500. A balanced spool valve 518 of the pressure control valve 502 is always used to control the actuation process of the intensifier piston 84. The half spool valve 520 of the timing control valve 504 is used to control the timing of the injection and how much fuel is injected through the needle valve 78. By having two independent control valves 502, 504, the injection pressure generation process through the intensifier piston 84 and the injection timing control process through the needle valve 78 are managed independently.

In the injector of FIG. 4, an advantageous strategy is to turn the pressure control valve 502 on ahead of turning the timing control valve 504 on. The pressure control valve 502 actuates the intensifier piston 84 and acts to prepare the fuel pressure and get ready for injection (no injection is possible with the timing control valve 504 in the off position). The pressure control valve 502 opens only once during an injection event and stays open throughout the injection event to provide constant injection pressure throughout the entire injection process. This allows the intensifier piston 84 to stay at either a down stroke compression motion or in a hydraulic lock mode with actuation fluid pressure applied to the intensifier piston 84 when the entire fuel injection is stopped as controlled independently by the timing control valve 504. The pressure control valve 502 is preferably shut off to vent actuating fluid through vents 537 (see FIG. 2) only when the entire fluid injection event, including, for example, pilot, main and post injection, is finished. The pressure control valve 502, preferably the balance spool valve 518, is relatively large. The pressure control valve 502 has less flow restriction and the response of the balance spool valve 518 is not as critical as the response of the small half spool valve 520 of the timing control valve 514.

Direct Needle Control

In FIG. 4, the coil 508 of the half spool valve 520 of the timing control valve is initially at off. Actuation fluid at rail pressure from the rail 542 is ported in and flows around the groove 544, through the passageway 546 and is in communication with the needle back 548 of the needle actuation piston 550. The needle actuation piston 550 is big enough to provide sufficient force (the combined force of the return spring 552 and the force generated on the needle back actuation surface 548 by the actuation fluid) to hold down the needle valve 78 and stop the needle valve 78 from opening at all injection pressure levels. In FIG. 4, the needle actuation piston 550 is depicted as a separate component from the needle valve 78, having a shank 554. The distal end 556 of the shank 554 bears on the upper margin 558 of the needle valve 78. The needle actuation piston 550 and the needle valve 78 could be formed as an integral component.

The return spring 552 bears on the needle back actuation surface 548 and is disposed in the variable volume chamber 553 that is formed in part by the needle back actuation surface 548. The opposing chamber 555 is also variable and is vented to a substantially ambient pressure actuating fluid reservoir. An additional variable volume chamber 559 is formed in part by the upper margin 558 of the needle valve 78. The chamber 559 is vented to a substantially ambient pressure fuel reservoir.

When the coil 508 of half spool valve 520 is turned on, the valve 520 is shifted to the vent position seated on the end cap stop 538, as depicted in FIGS. 3 and 4, and the needle back 548 is vented to ambient pressure level. The needle valve 78 may then be lifted up (opened) if the nozzle side fuel pressure acting on shoulder surface 82 generates a force that is higher than the minimum cranking pressure of the needle return spring 552 and some small amount of residual pressure acting on the needle back 548.

The needle valve 78 is closed at all times that the timing control valve 504 is turned off (rail pressure being ported in), as depicted in FIG. 2, the disc plate 526 being seated against the valve housing stop 534. This is true without regard to the disposition of the pressure control valve 502. If the pressure control valve 502 is open, as depicted in FIG. 3, closing the timing control valve 504 acts to close the needle valve 78, thereby putting the intensifier piston 84 into a state of hydraulic lock. This hydraulic lock is evidenced by the actuating fluid ported in by the pressure control valve 502 generating a force on the intensifier piston 84 and, with the needle valve 78 closed, no fuel is being injected so that the high pressure passage 74 is sealed off. Without injection occurring, a certain volume of fuel is trapped in the high pressure passage 74 and that trapped volume prevents the intensifier piston 84 from continuing its actuating compressive stroke.

There are several ways to operate the injection process as noted below.

(1) Prebuild Pressure.

As noted above, the pressure control valve 502 is turned on substantially prior to turning on the timing control valve 504. This ports high pressure actuating fluid to bear on the intensifier piston 84. The intensifier piston 84 is initially in a state of hydraulic lock since the timing control valve 504 is off and high pressure actuating fluid is bearing on the needle back 548 holding the needle valve 78 closed. The intensifier chamber 102 and plunger chamber 66 pressure are prebuilt and are ready to use. The fuel in the plunger chamber 66 is being pressurized but is not flowing due to the needle valve 78 being held in a closed disposition by the pressure on the needle back 548 caused by the actuating fluid ported through the timing control valve 504, the timing control valve 504 being in the off position as depicted in FIG. 2.

The timing control valve 504 is then turned on, as depicted in FIG. 3, to trigger the fuel delivery. The rail 542 to the timing control valve 504 is sealed off and the actuating fluid acting on the needle back 548 is vented to ambient via vent 539. The high pressure fuel from the plunger chamber 66 acting on the shoulder surface 82 of the needle valve 78 causes the needle valve 78 to open, resulting in the injection of pressurized fuel.

The timing control valve 504 can be turned on and off multiple times during an injection event to cause multiple independent injections and multiple dwell periods (during which no injection occurs), such as pilot, main and post injections. The pressure control valve 502 stays on during the entire injection event until the very end, continuously porting actuating fluid to the intensifier piston 84. The intensifier piston 84 goes though multiple downward compression and hydraulic lock states during an injection event as described immediately above.

(2) Slow Ramped Injection.

It may be desirable to have the initial portion of the rate of injection ramp up relatively slowly to the full rate of injection. This is possible with the dual control valve 500 of the present invention by turning on the timing control valve 504 prior to the pressure generation process. Turning on the timing control valve 504 results in the needle back 548 being vented to ambient through vent 539. In this condition, the spring preload of the return spring 552 stops the needle valve from lifting (opening) under pressurization until the force generated on the shoulder surface 82 by the rising fuel press exceeds the spring preload.

The pressure control valve 502 may then turned on to relatively gradually build up the actuating fluid pressure in the intensifier chamber 102 and thereby to gradually build up the fuel pressure in the plunger chamber 66. As soon as the fuel pressure acting on the shoulder surface 82 generates a force exceeding the needle return spring 552 preload force level, the needle valve 78 opens and injection starts gradually and ramps up over time to the full rate of injection. End of injection is always controlled by closing the needle valve 78 through turning the timing valve 504 off before the pressure control valve 502 is turned off. Turning the pressure control valve 502 off allows the intensifier piston 84 to return to its initial disposition ready for the succeeding injection event. This valve sequence provides for the full injection pressure being available for injection (since the intensifier piston 84 is still in its compression stroke) until injection is terminated by closing the needle valve 78 by turning the timing valve 504 off.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A unit fuel injector, the injector internally preparing fuel during an injection event at a pressure sufficient for injection into an internal combustion engine by means of an intensifier piston, comprising:

a single needle valve for injecting a single fuel into the internal combustion engine; and a selectively actuatable controller being in fluid communication with a source of pressurized actuating fluid and being in fluid communication with a substantially ambient actuating fluid reservoir, the controller having a first valve, responsive to a first electric actuator, for selectively independently porting actuating fluid to and venting actuating fluid from the intensifier piston and a second valve operably fluidly coupled to a needle valve first closing surface and responsive to a second electric actuator for selectively independently porting actuating fluid to and venting actuating fluid from the needle valve during the injection event for controlling opening and closing of the needle valve; wherein actuating fluid ported by the second valve to the needle valve first closing surface generates a force acting to close the needle valve.

2. The unit fuel injector of claim 1 wherein the two valves are disposed in a coaxial arrangement.

3. The unit fuel injector of claim 2 wherein the two valves are independently electrically actuated.

4. The unit fuel injector of claim 3 wherein each of the two valves are independently solenoid operated in a first direction and spring operated in an opposed second direction.

5. The unit fuel injector of claim 1 wherein the actuating fluid ported by the second valve to the needle valve first closing surface generates a force that is greater than an opposing force acting on a needle valve opening surface, the opposing force being generated by pressurized fuel.

6. The unit fuel injector of claim 1 wherein actuating fluid is being ported by the first valve to the intensifier piston, the actuating fluid ported by the second valve to the needle valve first closing surface acting to put the intensifier piston into a state of hydraulic lock.

7. The unit fuel injector of claim 6 wherein the second valve venting the actuating fluid ported to the needle valve first closing surface acts to free the intensifier piston from the state of hydraulic lock, the needle valve then being openable by the action of fuel pressurized by the intensifier piston acting on a needle valve opening surface.

8. The unit fuel injector of claim 1 wherein the second valve is cyclable between an open and a closed disposition a plurality of times during a single cycle of the first valve to effect a plurality of fuel injections and dwell periods during a single injection event.

9. The unit fuel injector of claim 1 wherein the second valve is shiftable to port actuating fluid to the needle valve first closing surface prior to shifting of the first valve to port actuating fluid to the intensifier piston, subsequent porting of the actuating fluid by the first valve to the intensifier piston acting to effect prebuilding fuel pressure.

10. The unit fuel injector of claim 1 further including a needle back piston being operably coupled to the needle valve.

11. The unit fuel injector of claim 10 wherein the needle back piston is in fluid communication with the second valve.

12. The unit fuel injector of claim 10 wherein the needle back piston includes a shank, the shank bearing on a top margin of the needle valve.

13. The unit fuel injector of claim 12 wherein the top margin of the needle valve defines in part a chamber, the chamber being vented to a substantially ambient fuel return.

14. The unit fuel injector of claim 11 wherein the needle back piston is translatably disposed in a bore, the bore defining a portion of a variable displacement chamber, a needle valve first closing surface of the needle back piston defining in part the variable displacement chamber.

15. The unit fuel injector of claim 14 wherein the bore defines a portion of a second variable displacement chamber in cooperation with the needle back piston, the second variable displacement chamber being vented to the substantially ambient actuating fluid reservoir.

16. The unit fuel injector of claim 14 wherein a return spring is disposed in the variable displacement chamber, the return spring exerting a bias on the needle valve first closing surface.

17. The unit fuel injector of claim 16 wherein the return spring bias on the needle valve first closing surface acts in cooperation with a fluid pressure on the needle valve first closing surface to generate a closing force on the needle valve.

18. The unit fuel injector of claim 17 wherein the needle valve first closing surface has an area exposable to actuating fluid that is sufficient for the generation of a closing force on the needle valve, the closing force exceeding an opposing needle valve opening force generated by high pressure fuel acting on the needle valve for a certain range of pressures of the actuating fluid.

19. A method of injection control for a fuel injector having only one needle valve for injecting fuel, comprising:

fluidly coupling a selectively actuatable controller with a source of pressurized actuating fluid and with a substantially ambient actuating fluid reservoir;

controlling opening and closing of the one needle valve by:

selectively independently porting actuating fluid to and venting actuating fluid from an intensifier piston by a first valve by a first electric actuator; and selectively independently porting actuating fluid to and venting actuating fluid from a needle valve during an injection event by a second valve by a second electric actuator and, the second valve being operably fluidly coupled to a needle valve first closing surface, the second valve generating a force acting to close the needle valve by porting actuating fluid by the second valve to the needle valve first closing surface.

20. The method of claim 19 including disposing the two valves in a coaxial arrangement.

21. The method of claim 20 including independently electrically actuating the two valves.

22. The method of claim 20 including independently solenoid operating each of the two valves in a respective first direction and spring operating the two valves in a respective opposed second direction.

23. The method of claim 19 generating a force by the second valve porting actuating fluid to the needle valve first closing surface, the force being greater than an opposing force acting on a needle valve opening surface by pressurized fuel.

24. The method of claim 23 including hydraulically locking the intensifier piston by the second valve porting actuating fluid to the needle valve first closing surface.

25. The method of claim 24 including unlocking the intensifier piston by the second valve venting the actuating fluid ported to the needle valve first closing surface and subsequently opening the needle valve by action of fuel pressurized by the intensifier piston acting an a needle valve opening surface.

26. The method of claim 19 including effecting a plurality of fuel injections and dwell periods during a single injection event by cycling the second valve between an open and a closed disposition a plurality of times during a single cycle of the first valve.

27. The method of claim 19 including prebuilding fuel pressure by:

shifting the second valve to port actuating fluid to the needle valve first closing surface;

subsequently shifting the first valve to port actuating fluid to the intensifier piston; and subsequently venting the actuating fluid by the second valve.

28. The method of claim 19 including:

continually exposing a second needle valve closing surface to actuating fluid; and generating a force on the second needle valve closing surface by pressurized actuating fluid effecting a needle valve valve opening pressure, the valve opening pressure being overcomable by a force of pressurized fuel acting on a needle valve opening surface.

29. The method of claim 28 including:

varying the needle valve valve opening pressure as a function of the pressure of the actuating fluid; and varying the actuating fluid pressure at least as a function of an engine operating speed.

30. The method of claim 19 including the first valve porting actuating fluid to the intensifier piston a single time during an injection event.

31. The method of claim 30 including the second valve porting actuating fluid to the needle valve to end injection prior to cessation of the first valve porting actuating fluid to the intensifier piston the single time during an injection event.

32. The method of claim 19 including effecting an injection control strategy during an injection event by selective porting of actuating by the second valve to the needle valve.

33. The method of claim 32 including slowly ramping up the rate of injection by the second valve venting the needle valve prior to the first valve porting actuating fluid to the intensifier piston.

34. The method of claim 32 including effecting a dwell in the rate of injection by the second valve porting actuating fluid to the needle valve and subsequently venting the needle valve while the first valve is porting actuating fluid to the intensifier piston.

35. The method of claim 32 including terminating injection by the second valve porting actuating fluid to the needle valve while the first valve is porting actuating fluid to the intensifier piston, the first valve subsequently venting the intensifier piston.

36. The method of claim 32 including varying a valve opening pressure of the needle valve by varying the pressure of the actuating fluid ported by the first valve to the needle valve.

37. A hydraulically actuated, intensified fuel injector having only one needle valve for injecting fuel, comprising:

a controller achieving a desired injection control strategy by selectively independently porting actuating fluid to and venting actuating fluid from an intensifier piston to control the compressive stroke of the intensifier piston and selectively independently porting actuating fluid to and venting actuating fluid from the one needle valve to control the opening and closing of the one needle valve during the injection event; wherein the controller includes a first control valve and a second control valve disposed in a coaxial arrangement, actuating fluid being ported by the first control valve to the intensifier piston, the second valve being operably fluidly coupled to a needle valve first closing surface, actuating fluid being ported by the second valve to the needle valve first closing surface acting to put the intensifier piston into a state of hydraulic lock.

38. The unit fuel injector of claim 37 wherein the two valves are independently electrically actuated.

39. The unit fuel injector of claim 38 wherein each of the two valves are independently solenoid operated in a first direction and spring operated in an opposed second direction.

40. The unit fuel injector of claim 37 wherein actuating fluid ported by the second valve to the needle valve first closing surface generates a force acting to close the needle valve.

41.The unit fuel injector of claim 40 wherein the actuating fluid ported by the second valve to the needle valve first closing surface generates a force that is greater than an opposing force acting on a needle valve opening surface, the opposing force being generated by pressurized fuel.

42. The unit fuel injector of claim 37 wherein the second valve venting the actuating fluid ported to the needle valve first closing surface acts to free the intensifier piston from the state of hydraulic lock, the needle valve then being openable by the action of fuel pressurized by the intensifier piston acting on a needle valve opening surface.

43. The unit fuel injector of claim 37 wherein the second valve is cyclable between an open and a closed disposition a plurality of times during a single cycle of the first valve to effect a plurality of fuel injections and dwell periods during a single injection event.

44. The unit fuel injector of claim 37 wherein the second valve is shiftable to port actuating fluid to the needle valve first closing surface prior to shifting of the first valve to port actuating fluid to the intensifier piston, subsequent porting of the actuating fluid by the first valve to the intensifier piston acting to effect prebuilding fuel pressure.

45. The unit fuel injector of claim 37 further including a needle back piston being operably coupled to the needle valve.

46. The unit fuel injector of claim 44 wherein the needle back piston is in fluid communication with the second valve.

47. The unit fuel injector of claim 45 wherein the needle back piston includes a shank, the shank bearing on a top margin of the needle valve.

48. The unit fuel injector of claim 47 wherein the top margin of the needle valve defines in part a chamber, the chamber being vented to a substantially ambient fuel return.

49. The unit fuel injector of claim 46 wherein the needle back piston is translatably disposed in a bore, the bore defining a portion of a variable displacement chamber, a needle valve first closing surface of the needle back piston defining in part the variable displacement chamber.

50. The unit fuel injector of claim 49 wherein the bore defines a portion of a second variable displacement chamber in cooperation with the needle back piston, the second variable displacement chamber being vented to the substantially ambient actuating fluid reservoir.

51. The unit fuel injector of claim 49 wherein a return spring is disposed in the variable displacement chamber, the return spring exerting a bias on the needle valve first closing surface.

52. The unit fuel injector of claim 51 wherein the return spring bias on the needle valve first closing surface acts in cooperation with a fluid pressure on the needle valve first closing surface to generate a closing force on the needle valve.

53. The unit fuel injector of claim 52 wherein the needle valve first closing surface has an area exposable to actuating fluid that is sufficient for the generation of a closing force on the needle valve, the closing force exceeding an opposing needle valve opening force generated by high pressure fuel acting on the needle valve for a certain range of pressures of the actuating fluid.

* * * * *